US005763996A

United States Patent [19]

Kim

[11] Patent Number: 5,763,996

[45] Date of Patent: Jun. 9, 1998

[54] CATHODE RAY TUBE

[75] Inventor: Jae-woo Kim, Ulsan, Rep. of Korea

[73] Assignee: Samsung Display Devices Co., Ltd., Kyungki-do, Rep. of Korea

[21] Appl. No.: 788,529

[22] Filed: Jan. 24, 1997

[30] Foreign Application Priority Data

Feb. 28, 1996 [KR] Rep. of Korea ..... 1996-5080

[51] Int. Cl.[6] ..... H01J 1/62

[52] U.S. Cl. ..... 313/479; 313/313; 313/242

[58] Field of Search ..... 313/479, 402, 313/313, 345, 242; 174/135 MS

[56] References Cited

U.S. PATENT DOCUMENTS

| | | | |
|---|---|---|---|
| 3,443,138 | 5/1969 | Schwartz | 313/313 X |
| 4,041,347 | 8/1977 | Deal et al. | 313/479 X |
| 4,092,444 | 5/1978 | Kilichowski | 313/479 X |
| 5,198,729 | 3/1993 | Powell | 313/479 X |
| 5,635,793 | 6/1997 | Ochiai et al. | 313/479 |

FOREIGN PATENT DOCUMENTS

| | | | |
|---|---|---|---|
| 0007751 | 1/1983 | Japan | 313/242 |

*Primary Examiner*—Ashok Patel

*Attorney, Agent, or Firm*—Leydig, Voit & Mayer, Ltd.

[57] ABSTRACT

A cathode ray tube is provided. The cathode ray tube according to the present invention includes a panel having a fluorescent film formed on the inner surface thereof, a shadow mask frame assembly disposed inside the panel, a funnel to which the panel is sealed and having an electron gun installed in a neck portion thereof and a deflection yoke installed around a cone portion thereof, and a magnetic field shielding portion which is installed along the wall of the funnel and includes a metal plate for blocking the influences of terrestrial magnetic fields. In the cathode ray tube according to the present invention, it is possible to block the influences of terrestrial magnetic fields with a magnetic field shielding portion having a simple structure.

5 Claims, 4 Drawing Sheets

CATHODE RAY TUBE

BACKGROUND OF THE INVENTION

The present invention relates to a cathode ray tube, and more particularly, to a cathode ray tube having an inner shield which prevents the paths of electronic beams emitted from an electron gun from being influenced by terrestrial magnetic forces.

FIG. 1 is a sectional diagram schematically illustrating the structure of a conventional cathode ray tube. As shown in FIG. 1, a general cathode ray tube includes a panel 10, a fluorescent film 11 having a pattern on the inside of the panel 10, a shadow mask frame assembly 12 which is fixedly installed at a location separated from the fluorescent film 11, and a funnel 20 sealed to the panel 10. The funnel 20 has a neck portion 21 in which an electron gun 22 is located and a cone portion 25 around which a deflection yoke 23 is installed.

In cathode ray tube having the described structure, pixels are defined by electrons emitted from the electron gun 22 and landing on specific positions of the fluorescent film 11. The electrons are selectively deflected by the deflection yoke 23 according to the scanning position of the fluorescent film 11. The pixels collective form a picture.

The electron beam emitted from the electron gun 22 of the cathode ray tube is easily influenced by the earth's polar magnetic field or other magnetic fields (hereinafter referred to as terrestrial magnetic fields), causing the electron beam to stray off path and land at an improper location on the fluorescent film 11.

In the conventional technology, to solve the above problem, the influences of terrestrial magnetic fields were blocked by surrounding the paths of the electron beams emitted from the electron gun 22 by an inner shield 30 a thin metal plate having uniform permeability located inside the cathode ray tube.

FIG. 2 is a perspective view schematically illustrating the state in which the above-mentioned inner shield 30 is mounted in the shadow mask frame assembly 12. As shown in FIG. 2, the conventional inner shield 30 includes a first wall 31*a* mounted on the shadow mask frame assembly 12 and extending roughly parallel to the wall of the funnel 20, and a second wall 31*b* which is roughly parallel to the panel 10, bent inward from the first wall 31*a*. Here, a flange 32 is formed on the first wall 31*a* for mounting of the shadow mask frame assembly 12.

However, since the conventional inner shield having the above structure is mounted on the shadow mask frame assembly using a clip, the inner shield may be shaken from its proper place due to vibrations when the inner shield is installed inside the cathode ray tube. Also, a separate clip must be manufactured in order to assemble the inner shield and an indented portion for loading the clip must be formed.

Also, since the conventional inner shield is installed in the free space of the cathode ray tube, the shield may interfere with the electron beams emitted from the electron gun as the deflection angle becomes wider.

SUMMARY OF THE INVENTION

It is an object of the present invention to provide a cathode ray tube in which an inner shield is easily installed and interference by an inner shield with an electronic beam is prevented.

To achieve the above object, there is provided a cathode ray tube, comprising a panel having a fluorescent film on the inner surface of the panel, a shadow mask frame assembly disposed inside the panel, a funnel to which the panel is sealed and having an electron gun installed in a neck portion of the funnel, and a deflection yoke installed around a cone portion of the funnel, and a magnetic field shielding portion located within and covered by the wall of the funnel and including a metal plate for blocking the influences of terrestrial magnetic fields.

The magnetic field shielding portion is preferably housed within the wall of the funnel. The magnetic field shielding portion may be attached on the surface of the wall of the funnel.

The magnetic field shielding portion is preferably installed between an end portion of the funnel which is sealed to the panel and the upper end of the deflection yoke. The magnetic field shielding portion is preferably an alloy including Fe, Ni, and Cr.

BRIEF DESCRIPTION OF THE DRAWINGS

The above object and advantages of the present invention will become more apparent by describing in detail a preferred embodiment with reference to the attached drawings in which.

DETAILED DESCRIPTION OF THE INVENTION

Figure 1:
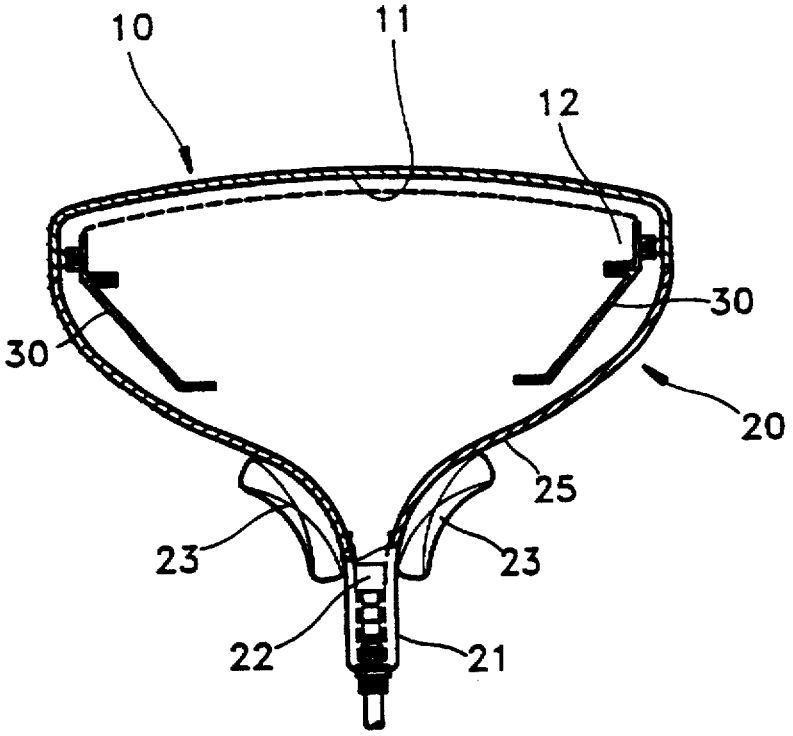
FIG. 1 (PRIOR ART)
FIG. 1 is a sectional view schematically illustrating the structure of a conventional cathode ray tube.
Figure 2:
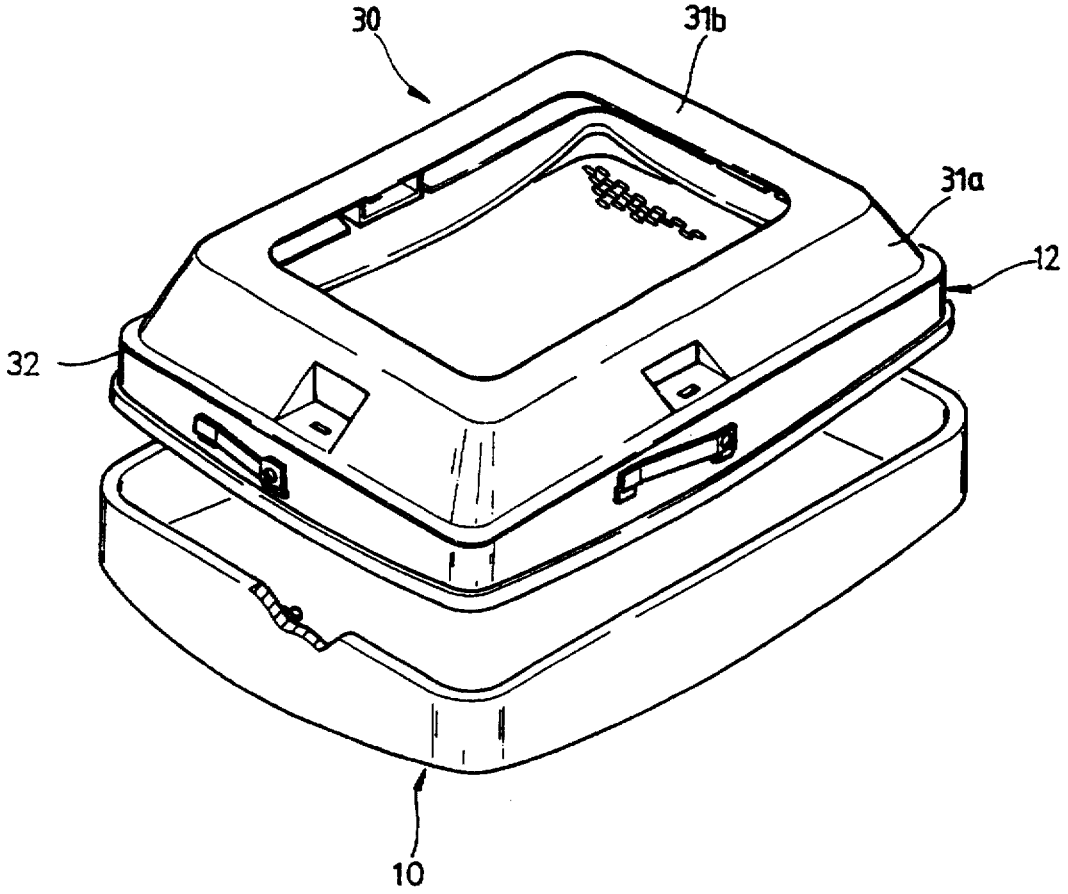
FIG. 2 (PRIOR ART)
FIG. 2 is a perspective view showing how the inner shield shown in FIG. 1 is mounted on a shadow mask frame assembly.
Figure 3:
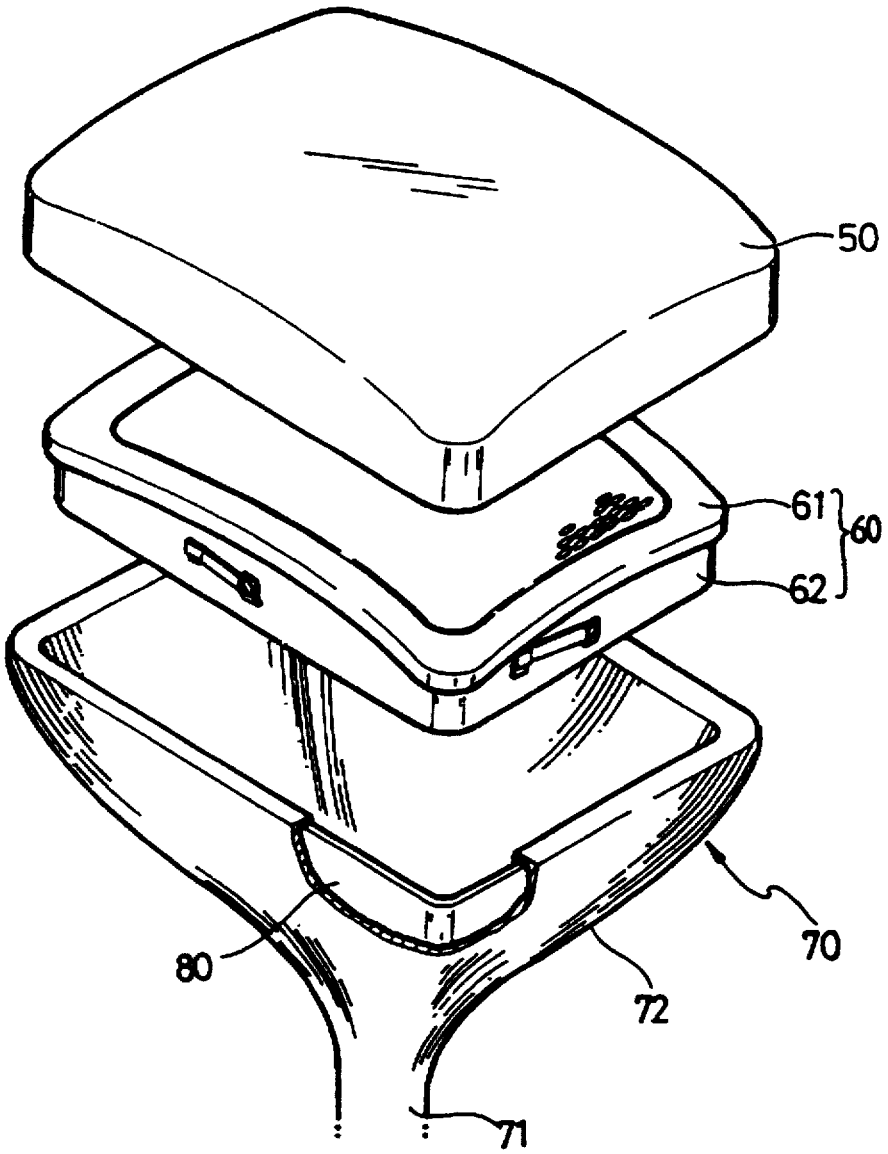
FIG. 3 is an exploded perspective view of a cathode ray tube according to the present invention in which a portion of the wall of the cathode ray tube is partially cut away.
Figure 4A:
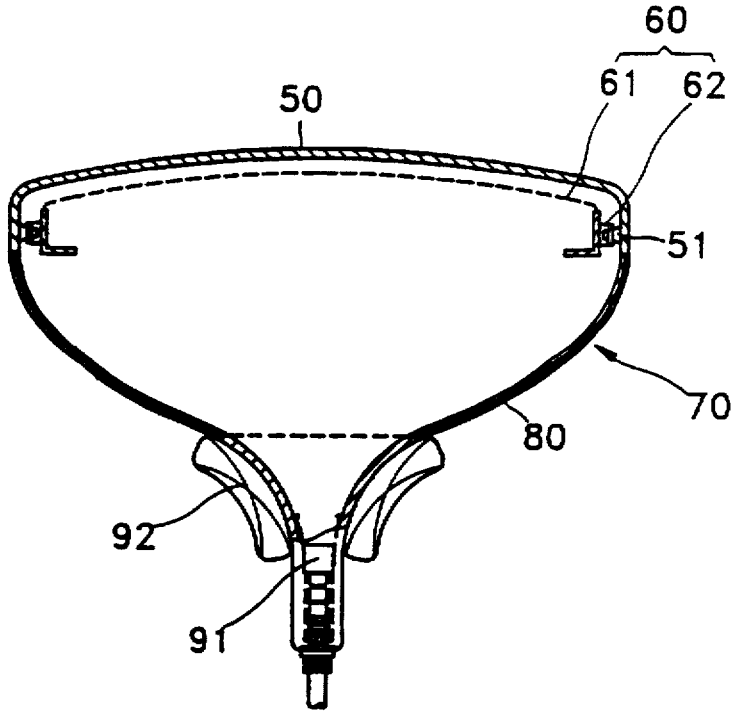
FIG. 4A is a sectional view of the cathode ray tube shown in FIG. 3.
Figure 4B:
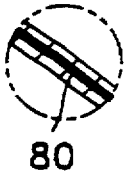
FIG. 4B is a detailed view of the wall of the cathode ray tube.

FIGS. 3, 4A and 4B show a cathode ray tube according to the present invention comprising: a panel 50 having a fluorescent film (not shown) formed therein; a shadow mask frame assembly 60 installed inside the panel 50, the shadow mask frame assembly 60 having a shadow mask 61 spaced from the fluorescent film by a predetermined distance and a frame 62 coupled to the edge portion of the panel 50 by a stud pin 51; a funnel 70 which forms an electron free space by being sealed to the panel 50; an electron gun 91 mounted inside a neck portion 71 of the funnel 70; and a deflection yoke 91 installed around a cone portion 72 of the funnel 70.

According to the characteristics of the present invention, a magnetic field shielding portion 80 for blocking the influence of terrestrial magnetic fields is housed inside the wall of the funnel 70 as shown in FIGS. 4 and 4B The magnetic field shielding portion 80 is a band-shaped thin metal plate corresponding to the shape of the wall of the funnel 70 and having a width corresponding to the length from the edge of the funnel 70 to the upper end of the cone portion 72, namely, the deflection yoke 92.

The thin metal plate forming the magnetic field shielding portion 80 is preferably formed of a material whose thermal expansion coefficient. More preferably, the thin metal plate is formed of a material having the same thermal expansion coefficient as that of glass constituting the funnel 70. This condition prevents the funnel 70 from being damaged due a difference between thermal expansion amounts of the two materials in the cathode ray tube. The thin metal plate constituting the magnetic field shielding portion 80 is preferably an alloy containing Fe, Ni, and Cr.

The operation of the cathode ray tube according to the present invention having the structure described above will be described with reference to FIGS. 4A and 4B

In cathode ray tube according to the present invention electron beams emitted from the electron gun 91 and landing on specified positions on the fluorescent film defines pixels. The electrons are selectively deflected by the deflection yoke 92 according to the scanning position of the fluorescent film.

In the process of forming the pixels as mentioned above, terrestrial magnetic fields act in a horizontal direction, i.e. east-west, and in a vertical direction, i.e., north-south, with respect to the paths of the electron beams emitted from the electron gun 91 of the cathode ray tube according to the installation position of the cathode ray tube. However, in the cathode ray tube according to the present invention, since the magnetic field shielding portion 80 is housed inside the wall of the funnel 70, the influence of terrestrial magnetic fields is blocked, so the electron beams emitted from the electron gun 91 are not influenced by the terrestrial magnetic fields.

Also, since the magnetic field shielding portion 80 is housed inside the wall of the funnel 70, there is no risk that the electronic beam which moves in free space will be interfered with by the magnetic field shielding portion 80 even if the deflection angle of the cathode ray tube is wide.

As mentioned above, in the cathode ray tube according to the present invention, since the magnetic field shielding portion corresponding to the conventional inner shield is housed inside the wall of the funnel, it is possible to prevent the magnetic field shielding portion from shaking and drifting from the shadow mask frame assembly due to vibrations. Also, since the magnetic field shielding portion can be integrally manufactured with the funnel, it is possible to reduce manufacturing processes compared with the conventional technology.

In the cathode ray tube according to the preferred embodiment of the present invention, the magnetic field shielding portion is described as housed inside the wall of the funnel. However, it is possible to attach the magnetic field shielding portion to the surface of the funnel inside or outside the cathode ray tube.

The present invention is not restricted to the above embodiments and many variations are possible within the scope and spirit of the present invention by anyone skilled in the art.

What is claimed is:

1. A cathode ray tube comprising:

a panel having a fluorescent film on an inner surface of said panel;

a shadow mask frame assembly disposed inside said panel;

a funnel having a wall and neck and cone portions, sealed to said panel;

an electron gun installed in said neck portion of said funnel;

a deflection yoke installed around said cone portion of said funnel; and a magnetic field shielding member located within and enveloped by the wall of said funnel and including a metal plate for blocking terrestrial magnetic fields.

2. The cathode ray tube as claimed in claim 1, wherein said metal plate has a band shape.

3. The cathode ray tube as claimed in claim 2, wherein said metal plate is an alloy including Fe, Ni, and Cr.

4. The cathode ray tube as claimed in claim 1, wherein said magnetic field shielding member is located between an end of said funnel sealed to said panel and said deflection yoke.

5. The cathode ray tube as claimed in claim 1, wherein said metal plate is an alloy including Fe, Ni, and Cr.

* * * * *